US007044671B2

(12) United States Patent
Parikh et al.

(10) Patent No.: US 7,044,671 B2
(45) Date of Patent: May 16, 2006

(54) APPLICATOR FOR CLEANING TEETH

(75) Inventors: Rita Parikh, Paramus, NJ (US); Arthur Fox, Randolph, NJ (US); Diane Lorello, Lake Hopatcong, NJ (US)

(73) Assignee: Warner-Lambert Company LLC, Morris Plains, NJ (US)

( * ) Notice: Subject to any disclaimer, the term of this patent is extended or adjusted under 35 U.S.C. 154(b) by 0 days.

(21) Appl. No.: 10/672,200

(22) Filed: Sep. 26, 2003

(65) Prior Publication Data

US 2005/0069373 A1 Mar. 31, 2005

(51) Int. Cl.
*B43M 11/06* (2006.01)

(52) U.S. Cl. ..... 401/183; 401/261; 401/25; 401/195; 604/3

(58) Field of Classification Search ..... 401/183, 401/195, 132–135, 152, 156, 162, 25, 261, 401/265, 266; 604/3; 123/329
See application file for complete search history.

(56) References Cited

U.S. PATENT DOCUMENTS 2,141,969 A * 12/1938 Benz ..... 601/141
3,324,855 A 6/1967 Heimlich
3,458,268 A * 7/1969 Wozab et al. ..... 401/261
3,519,364 A * 7/1970 Truhan ..... 401/177
3,672,378 A * 6/1972 Silverman ..... 132/329
3,775,848 A * 12/1973 Barnett ..... 132/329
3,958,571 A 5/1976 Bennington
4,176,980 A * 12/1979 O'Neal et al. ..... 401/162
4,415,288 A * 11/1983 Gordon et al. ..... 401/132
4,451,164 A * 5/1984 Roberts, Jr. ..... 401/196
4,795,421 A * 1/1989 Blasius et al. ..... 604/1
4,863,422 A 9/1989 Stanley
4,875,602 A 10/1989 Chickering et al.
5,098,297 A * 3/1992 Chari et al. ..... 433/215
5,133,971 A * 7/1992 Copelan et al. ..... 424/448
5,702,035 A 12/1997 Tsao
5,927,884 A 7/1999 Kao
5,967,152 A * 10/1999 Rimkus ..... 132/308
6,070,286 A * 6/2000 Cardarelli ..... 15/167.1
6,132,445 A * 10/2000 Pavanelli ..... 606/161
6,205,611 B1 * 3/2001 Vigil ..... 15/244.1
6,536,979 B1 * 3/2003 Kenny et al. ..... 401/270
6,929,475 B1 * 8/2005 Dragan ..... 433/89

* cited by examiner

*Primary Examiner*—Justine R. Yu
*Assistant Examiner*—Huyen Le
(74) *Attorney, Agent, or Firm*—Evan J. Federman; Darryl Little

(57) ABSTRACT

A disposable teeth cleaning applicator device. An elongated tubular shaft member has an applicator tip member at one end and a toothpick device at the other end. A liquid dental material is positioned inside the tubular shaft member and, once released, is squeezed or allowed to flow into the applicator tip member and used to clean a person's teeth.

1 Claim, 3 Drawing Sheets

APPLICATOR FOR CLEANING TEETH

TECHNICAL FIELD

The present invention relates to teeth and mouth cleaning devices, and more particularly to disposable liquid mouth cleaning applicator devices.

BACKGROUND OF THE INVENTION

The use of toothbrushes and other teeth cleaning and breath refreshing devices are in common use today. However, the devices are typically used only in a home environment. Persons typically do not take toothbrushes and tubes of toothpaste with them as part of their daily activities. Moreover, when utilizing toothpaste and other teeth cleaning materials, it is typically necessary to have a supply of liquid, such as water, to rinse and otherwise dispose of the residue.

It is also uncommon for persons to carry various liquid mouth fresheners with them on a daily basis, but typically again utilize those products in their home environments. There are some materials which are easy to carry and use, such as mints and gums, that also are often used for freshening a person's breath, but these are ineffective in removing germs, food, and other material buildup on the teeth.

There is a need for devices and methods for conveniently cleaning the person's teeth in a convenient manner, without the need to carry and utilize toothbrushes, tooth paste and other bulky and messy devices and materials. There also is a need for small disposable devices for cleaning teeth in an easy and discrete manner, particularly without the need for rinsing solutions.

SUMMARY OF THE INVENTION

The present invention provides convenient disposable applicators (applicator devices) which can be used for cleaning a person's teeth in a quick, efficient and discrete manner. An elongated tubular shaft member is provided with an applicator tip member at one end. An oral care composition, such as a liquid or gel, is provided in the shaft member and, upon manual manipulation of the shaft member, is allowed to flow or advance into the applicator tip member and be applied to the person's teeth or tongue, as well as other oral mucosal surfaces. The applicator member can be formed from natural or synthetic sponge or mesh like materials which are sufficiently firm to be used to clean matter from the teeth, yet are sufficiently soft and porous to allow liquid or gel-type compositions to be passed through them onto the teeth. Also, preferably the applicator has an abrasive surface, or is made of a material which has abrasive characteristics to it.

The oral care composition is positioned in the tubular shaft member and can be released for passage into the applicator member by breaking off the end of the shaft opposite to the applicator member. This provides atmospheric pressure which allows the material to flow. In the alternative, the tubular shaft member can be made of a soft material, which is deformable and which can be squeezed or manually manipulated in order to force the composition into and through the applicator member.

In another embodiment, the oral care composition can be positioned in a frangible capsule in the tubular shaft member. In this embodiment, manual squeezing or bending of the tubular member will break the frangible member thereby releasing the oral care composition and allowing it to be passed into the applicator tip member. In this embodiment, the tubular member should also be sufficiently flexible such that manual manipulation can assist in passing the dental material into the applicator member.

The oral care composition can comprise a variety of oral care actives, such as, anti-caries agents, such as stannous or fluoride ion sources, antimicrobial agents and tooth whitening agents. The antimicrobial agents are effective against the germs (i.e., microbial species) typically associated with halitosis, dental plaque and gingivitis.

Examples of oral care actives suitable for use in the devices of the present invention can be found in U.S. Pat. No. 6,121,315 issued Sep. 19, 2000 to Nair et al. and U.S. Pat. No. 6,514,484 issued Feb. 4, 2003 to Rajaiah et al. both of which are herein incorporated by reference in their entirety. Orally acceptable carriers useful in forming the oral care compositions can be found in U.S. Pat. No. 5,945,088 issued Aug. 31, 1999 to Delli Santi et al. and U.S. Pat. No. 6,355,229 issued Mar. 12, 2002 to Adamy, both of which are herein incorporated by reference in their entirety.

A toothpick-type or floss-applicator device can be provided on the tubular member opposite the applicator tip member. The toothpick or floss-applicator member can be adapted to be broken off from the tubular shaft member in order to be utilized separately or retained for later use.

In use, once the oral care composition is released into the applicator member, the applicator member is rubbed gently over the teeth and mouth surfaces such as the tongue and oral mucosa. This kills germs or removes stains and unsightly plaque. Preferably, the applicator devices are individually wrapped or packaged in an easy to carry container or package. If a container or package is utilized, preferably a reflective surface is provided on it to be used as a mirror, if needed.

In one embodiment, the applicator devices are disposable and provide an easy and efficient way to clean a person's teeth whenever and wherever desired. It is not necessary to have a rinsing solution or liquid since no rinsing is needed after use.

DESCRIPTION OF PREFERRED EMBODIMENTS

Figure 1:
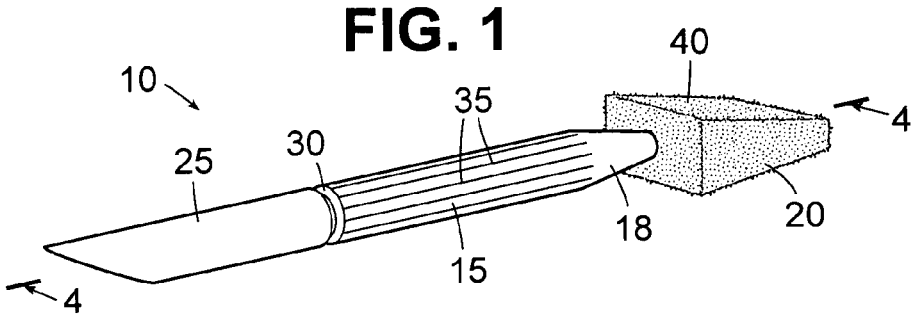
FIG. 1 is a perspective view of an applicator device in accordance with the present invention.
Figure 2:
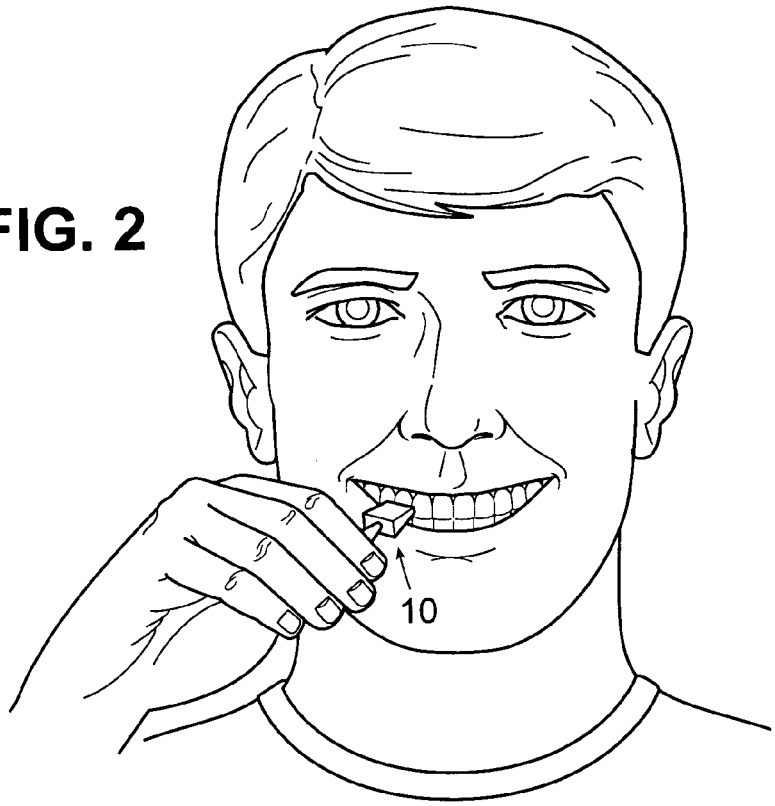
FIG. 2 illustrates the use of the present invention.

One embodiment of the present invention is depicted in FIGS. 1–4 and referred to generally by the reference numeral 10. One use of the inventive applicator device 10 is shown in FIG. 2.

Figure 4:
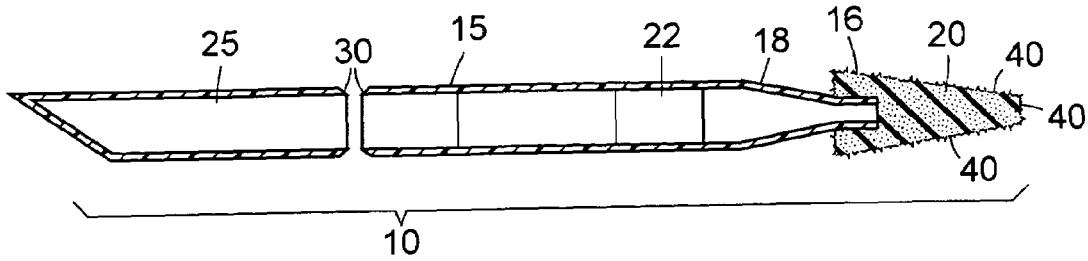
FIG. 4 is a cross-sectional view of the embodiment shown in FIG. 1 with the toothpick end broken off.

The applicator device 10 includes an elongated tubular shaft member 15 with an applicator member or tip 20 positioned at one end. The opposite end of the tubular shaft member 15 is an optional pick member 25. The pick member 25 can be integrally formed as part of the shaft member 15 and adapted to be broken off as shown in FIG. 4. For this purpose, a groove or recess 30 is provided around the shaft member 15 at a predetermined location. The pick member can be in the form of a toothpick, a floss and/or floss-applicator, a rubber dental pick, an interproximal brush or similar type device used to pick food from between teeth.

Figure 3:
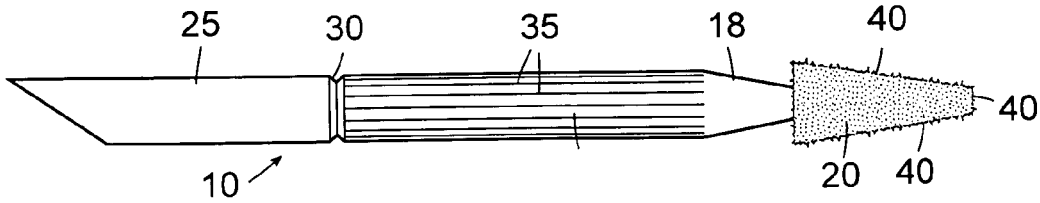
FIG. 3 is a planar elevational view of one embodiment of the present invention.

The tubular shaft member 15 is preferably several inches in length so that it can be held comfortably and easily in a person's hand, as shown in FIG. 2. For this purpose, the tubular shaft member 15 can be on the order of ⅛–¼ inch in diameter and have a length on the order of 3–4 inches. Also, as shown in FIGS. 1 and 3, a plurality of longitudinal grooves 35 can be provided along the length of the shaft member in order to allow it to be gripped and utilized more easily. In this regard, it is understood that other types of roughening or gripping mechanisms can be utilized on the tubular shaft member, or that none can be provided.

In one embodiment, the applicator member or tip 20 is made from a sponge material and has a wedge-shape as shown in FIGS. 1–4. The applicator tip member 20 is securely attached in a conventional manner, such as by gluing, heat staking, mechanically interlocking, laser welding, or the like to the end 16 of the tube member 15. In this regard, the portion of the tube member 15 adjacent the end 16 can have a tapered shape 18, although a tapered section is not a necessary part of the invention. It is sufficient that the applicator tip member, whatever it may be, is securely fastened to or integrally molded with the tubular shaft member such that it is not easily dislodged or become disconnected during use.

Preferably, the applicator tip member has an abrasive surface 40 on all of the exposed surfaces. This allows the applicator device to be more efficient in cleaning the teeth. Abrasive materials useful in forming the abrasive surface 40 include all known abrasive materials as well as combinations and agglomerates of such materials. Softer abrasive particles (e.g., those having a Mohs' hardness in the range between 1 and 7) can be applied to provide the abrasive surface 40. Suitable soft abrasives include, without limitation, inorganic materials such as flint, silica, pumice, and calcium carbonate as well as organic polymeric materials such as polyester, polyvinylchloride, methacrylate, methylmethacrylate, polycarbonate, and polystyrene as well as combinations of any of the foregoing materials. A wedge shape is preferred since it would allow the applicator device to be more useful in cleaning the spaces between a person's teeth.

Figure 6:
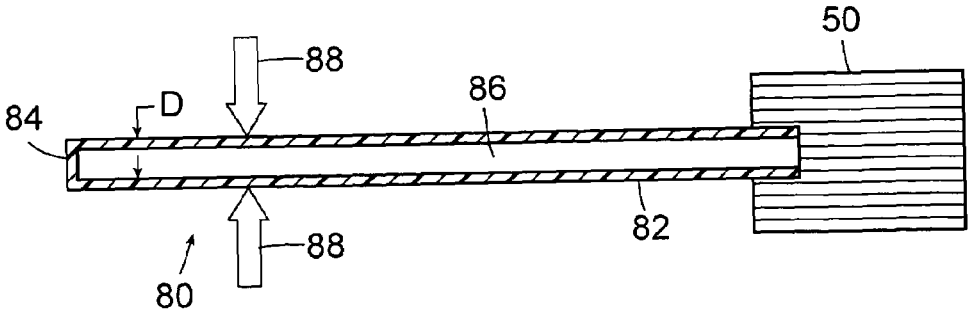
FIG. 6 illustrates still another alternate embodiment of the invention.

An alternate type of applicator tip member 50 is shown in FIG. 6. In this embodiment, the applicator tip member consists of a plurality of synthetic fibers or fibrous-type members that are compressed or secured together by any conventional means (e.g., in the form of a mesh). In this regard, the synthetic material should be sufficiently firm in order to allow the applicator to be used in its desired manner of cleaning teeth and can include polymeric or plastic materials, such as polyamides (e.g., nylon); polyesters (e.g., polybutylene terephthalate) as well as thermoplastic polymers of olefinic monomers, (e.g., ethylene, propylene, butylene, and the like). This includes their homopolymers and copolymers of these monomers with other ethylenically unsaturated monomers where the copolymer contains at least 25% of the olefinic monomer. Other polymeric material that can be used include the nylon type products prepared from reaction polycarboxylic acids with polyamines and suitable modifications thereof. The applicator tip member 50 can be, for example, a series of bristles such as those commonly used on toothbrushes today, or a bundle of fibers, held closely together.

Figure 7:
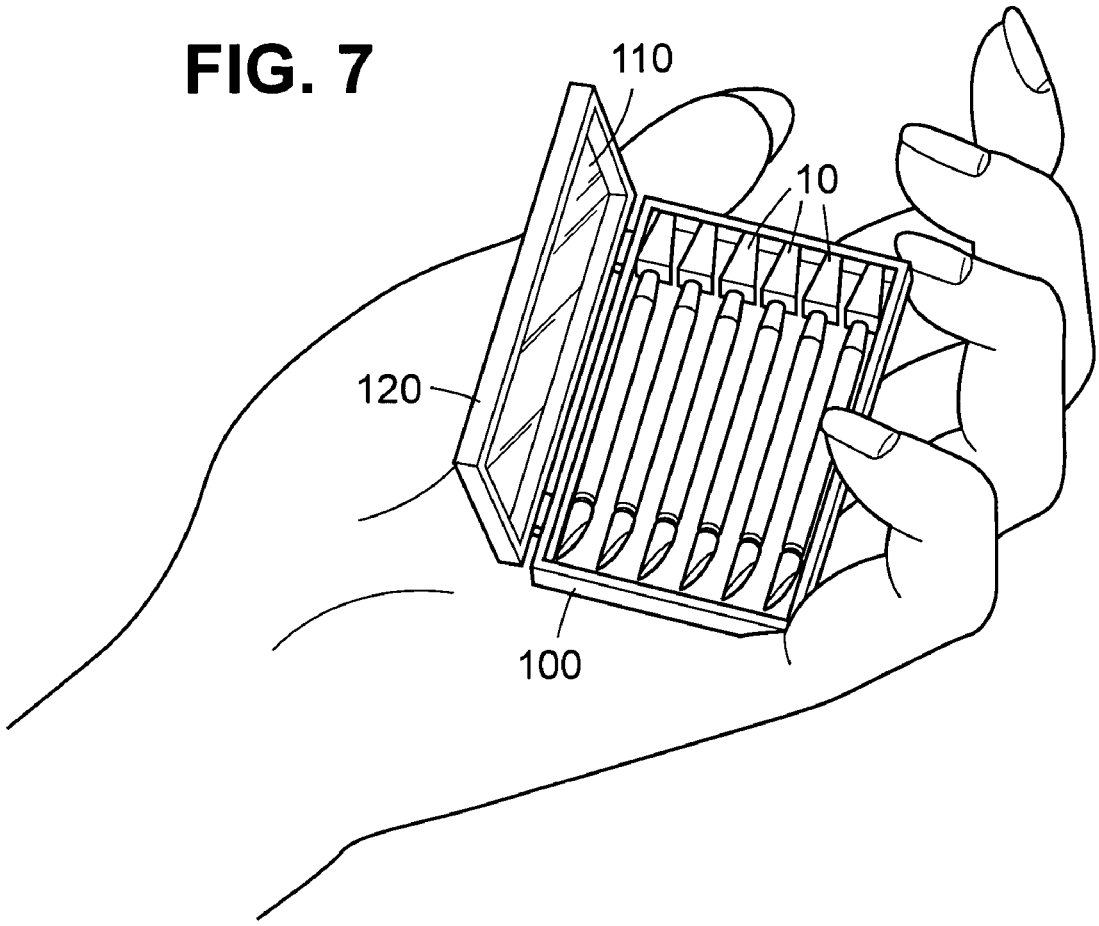
FIG. 7 illustrates a package or container in which the inventive applicator devices can be packaged.

Each of the individual applicator devices are preferably disposable and can be individually wrapped. They also can be provided in a separate package or container, such as container 100 as shown in FIG. 7. The container 100, as shown, is small, flat and easy to carry. A number of the applicator devices 10, six for example as shown in package 100, can be positioned in the container. Also, preferably a reflective surface, such as a mirrored surface 110, is provided as part of the container 100. The reflective surface can be provided on the inside of the cover 120 (as shown in FIG. 7), although the reflective surface could also be provided on any other surface, such as the front or back of the container.

There are several mechanisms which can be utilized in order to dispense the oral care composition from the applicator device into the applicator tip member and thus be used to clean the teeth and mouth. Several embodiments are described below. It is understood, of course, that other mechanisms and methods for releasing the oral care composition and passing it into the applicator tip member can be utilized in accordance with the present invention.

One preferred way to allow the oral care composition in the applicator tubular shaft member 15 to be passed into the applicator tip member 20 is shown in FIG. 4. In this regard, a quantity of oral care composition 22, which preferably is in the form of a liquid or gel, is positioned and sealed in the tubular member 15. In one embodiment, a second material, such as a glycerin or gel-like substance 24 is also provided in tubular member 15, and positioned between the oral care composition 22 and the applicator tip 20. The second material 24 is used to plug or block the flow or passage of the oral care composition into the applicator tip member until the device is ready for use. Both the oral care composition and second material are maintained in the tubular member and prevented from movement by surface tension and a lack of atmospheric and manual pressure. For example, as shown, the end 15A of the tubular member 15 is sealed when the applicator device is manufactured. In order to release the oral care composition 22, the end 25 is broken off from the tubular body member 15, as shown in FIG. 4. This can be done by manual pressure and manipulation by the user. Once the end 25 is broken off, the opening of the inside of the tubular member to atmospheric pressure allows the oral care composition 22 and second material 24 to flow. At this point, the applicator device 10 is held in a vertical orientation with the applicator tip member 20 positioned downwardly. The oral care composition 22 is then allowed to flow by gravity through the second material into the applicator tip member where it can be utilized to clean the teeth. If desired, manual pressure by the user on the outside of the tubular shaft member can also be used to assist in forcing the dental material through the gel or glycerin member 24 and into the applicator tip member. A similar mechanism is described, for example, in U.S. Pat. No. 5,702,035, herein incorporated by reference in its entirety. Alternatively, the oral care composition can be dispensed using a variety of other dispensing mechanisms. Other dispensing mechanisms are described, for example, in U.S. Pat. Nos. 3,324,855, 3,958,571, 4,863,422 and 4,875,602, each of which is herein incorporated by reference in its entirety.

Once the applicator device in accordance with the present invention is utilized, it can be easily disposed of. It is not necessary to attempt to store a wet brush and tube of toothpaste. Also, a rinsing solution is not needed.

In one embodiment, the oral care composition is a liquid, such as Listerine® mouth rinse from the Pfizer Consumer Healthcare Division. Listerine is a germ-fighting composition which is also used to refresh a person's breath. Listerine comprises the essential oils: menthol, thymol, eucalyptol and methyl salicylate. A more detailed discussion of the Listerine® formulations can be found in U.S. Pat. No. 6,121,315 to Nair et al., previously incorporated herein by reference in its entirety.

If the pick device 25 is broken off from the tubular shaft member 15, it can be retained by the user for further use. It is also possible, of course, to use the pick end 25 of the applicator device 10 prior to release of the dental material into the applicator tip member.

Figure 5:
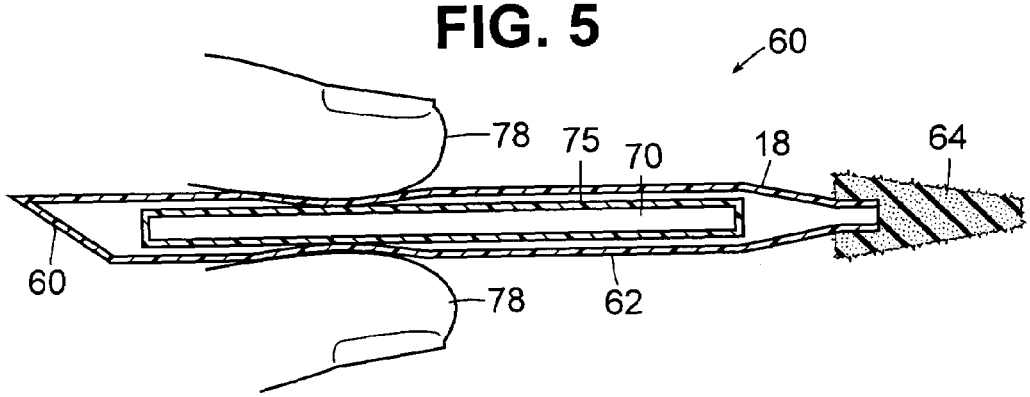
FIG. 5 illustrates an alternate embodiment of the invention.

An alternate embodiment of the present invention is shown in FIG. 5 and indicated generally by the reference numeral 60. The applicator device 60 an elongated tubular shaft portion 62 with an applicator tip member 64 at one end and a pick-type device 66 at the opposite end. The applicator tip member 64 and pick device 66 are similar to those described above with reference to the embodiment set forth and described in FIGS. 1–4. In the FIG. 5 embodiment, however, the pick end member is not frangible or removable from the tubular shaft member 62.

The tubular shaft member 62 is preferably made from a thin plastic material which is bendable or squeezable by the user. An oral care composition 70 is positioned inside a frangible capsule member 75 which is positioned inside the tubular shaft member 62. The frangible capsule member can be made from a glass material, although any other type of thin frangible material could be utilized.

In order to utilize the embodiment shown in FIG. 5, manual pressure is applied to the external surfaces of the tubular shaft member 62, such as illustrated by fingers 78 of a user. This squeezing force applied to the tube member is sufficient to fracture the capsule 75 and allow the oral care composition 70 to be released. It is also possible to bend the tubular member 62 in order to break the capsule 75 and release the oral care composition. In any event, once the oral care composition 70 is released, the tubular shaft member 62 can be continued to be squeezed in order to force the oral care composition into the applicator tip member 64. The oral care composition can also be allowed to flow into the applicator tip member by gravity. At that point, the applicator device 60 can be utilized in the same manner as the embodiments described above.

Another preferred embodiment of the present invention is shown in FIG. 6 and designated generally by reference numeral 80. The applicator device 80 has a tubular shaft member 82 with an applicator tip member 50. The applicator tip member 50 is an alternative to the wedge-shaped sponge applicator tip member 20 and is described above. The end 84 of the tubular shaft member 82 opposite the applicator tip member 50 is shown having a blunt sealed end, although it is also possible to provide a pick device member on the end 84. A quantity of oral care composition 86 is provided inside the tubular shaft member 82. In use, pressure is applied manually to the external surface of the tubular shaft member as represented by arrows 88. The manual pressure forces the oral care composition 86 into the applicator tip member 50 where it can be used for cleaning the person's teeth.

The diameter "D" of the tubular shaft member 82 is sufficiently small in order to prevent the liquid oral care composition 86 from flowing or migrating along the tubular shaft member and into the tip member 50 without external pressure. In this regard, preferably the inner diameter of the tubular shaft member is on the order of 1/16–1/8 of an inch.

With the present invention, a neat, easy way to clean a person's teeth and mouth is provided whenever and wherever desired, for example, in the office, in the car, or after a meal. When the inventive applicator device is utilized, the applicator tip member 20, 50 is rubbed gently over the surfaces of the teeth and between the teeth. This kills germs and removes stains and unsightly plaque. The applicator tip member can also be rubbed gently on the gum tissue, tongue and other oral mucosal surfaces, if desired. The use of the device provides a polished teeth feeling, as well as a cleaner, fresher taste in the mouth. It is also not necessary to have water or a source of another rinsing solution available since rinsing of the teeth or mouth is not needed after use of the present applicator device.

While the invention has been described in connection with one or more embodiments, it is to be understood that the specific mechanisms, processes and procedures which have been described are merely illustrative of the principles of the invention, numerous modifications may be made to the methods and apparatus described without departing from the spirit and scope of the invention as defined by the appended claims.

What is claimed is:

1. An applicator device for cleaning the teeth and mouth comprising 1.) an elongated tubular shaft member with an applicator tip member positioned at one end, 2.) an oral care composition positioned inside said tubular shaft member and adapted to be released and passed into said applicator tip member for use in cleaning a person's teeth, tongue and mouth and 3.) a removable pick member positioned at the end of the tubular shaft member opposite said applicator tip member, wherein said applicator tip member has at least one abrasive surface and wherein said applicator tip comprises a sponge material and has a three-dimensional wedge shape suitable for cleaning the spaces between teeth and further wherein said tubular shaft member comprises a groove to facilitate removal of said pick member.

* * * * *